US008375875B2

(12) United States Patent
Kim et al.

(10) Patent No.: US 8,375,875 B2
(45) Date of Patent: Feb. 19, 2013

(54) LNG CARRIER HAVING AN LNG LOADING AND UNLOADING SYSTEM

(75) Inventors: Chull Yun Kim, Seoul (KR); Man Heui Ahn, Geoje-si (KR); Dong Hyun Lee, Geoje-si (KR)

(73) Assignee: Samsung Heavy Ind. Co., Ltd. (KR)

( * ) Notice: Subject to any disclaimer, the term of this patent is extended or adjusted under 35 U.S.C. 154(b) by 292 days.

(21) Appl. No.: 12/922,770

(22) PCT Filed: Oct. 22, 2008

(86) PCT No.: PCT/KR2008/006235

§ 371 (c)(1),
(2), (4) Date: Sep. 15, 2010

(87) PCT Pub. No.: WO2009/119953

PCT Pub. Date: Oct. 1, 2009

(65) Prior Publication Data

US 2011/0011329 A1 Jan. 20, 2011

(30) Foreign Application Priority Data

Mar. 28, 2008 (KR) ..... 10-2008-0028727

(51) Int. Cl.

| | |
|---|---|
| ***B63B 25/08*** | (2006.01) |
| ***B63B 27/30*** | (2006.01) |
| ***F17C 6/00*** | (2006.01) |
| ***F17C 9/02*** | (2006.01) |
| ***F17C 13/08*** | (2006.01) |
| ***F25J 1/00*** | (2006.01) |

(52) U.S. Cl. ..... 114/74 R; 62/50.2; 62/53.2

(58) Field of Classification Search ..... 114/74 R–74 A; 441/3–5; 62/50.1, 50.2, 53.2, 611–614
See application file for complete search history.

(56) References Cited

U.S. PATENT DOCUMENTS

| | | | | |
|---|---|---|---|---|
| 5,375,547 | A | 12/1994 | Abe et al. | |
| 6,546,739 | B2 | 4/2003 | Frimm et al. | |
| 7,004,095 | B2 | 2/2006 | Bronneberg et al. | |
| 2010/0162939 | A1 * | 7/2010 | Morimoto | 114/74 R |

FOREIGN PATENT DOCUMENTS

| | | | |
|---|---|---|---|
| JP | 2011230550 | A * | 11/2011 |
| KR | 10-0305513 | | 11/2001 |
| KR | 10-2004-0005008 | | 1/2004 |
| KR | 10-2007-0020162 | | 2/2007 |
| KR | 10-0827398 | | 5/2008 |

* cited by examiner

*Primary Examiner* — Ajay Vasudeva
(74) *Attorney, Agent, or Firm* — Harness, Dickey & Pierce, P.L.C.

(57) ABSTRACT

An LNG carrier having an LNG loading and unloading system includes a submerged turret loading (STL) system for introducing and discharging a natural gas; a liquefaction plant for liquefying the natural gas introduced through the submerged turret loading system into a cryogenic liquefied natural gas; at least one self-supporting storage tank installed in the LNG carrier for storing the liquefied natural gas, the self-supporting storage tank arranged in such a manner that the liquefied natural gas is loaded to and unloaded from the LNG carrier through the self-supporting storage tank; and at least one membrane type storage tank arranged in a neighboring relationship with the self-supporting storage tank, the membrane type storage tank kept in fluid communication with the self-supporting storage tank. The LNG carrier further includes a regasification plant for regasifying the liquefied natural gas stored in the self-supporting storage tank.

13 Claims, 3 Drawing Sheets

LNG CARRIER HAVING AN LNG LOADING AND UNLOADING SYSTEM

TECHNICAL FIELD

The present invention relates to an LNG carrier having an LNG loading and unloading system and, more specifically, to an LNG carrier having an LNG loading and unloading system in which a membrane type storage tank and a self-supporting storage tank are arranged in combination and in which a liquefied natural gas is loaded and unloaded through the self-supporting storage tank so as to minimize the influence of sloshing.

BACKGROUND ART

As is generally known in the art, a liquefied natural gas (sometimes referred to as an "LNG" hereinbelow) refers to colorless, transparent, cryogenic liquid obtained by cooling a natural gas mainly composed of methane to a temperature of −163° C. and reducing the volume thereof to about 1/600.

The LNG liquefied into a cryogenic state under an atmospheric pressure or a pressure higher than the atmospheric pressure is stored in a storage tank. The LNG thus stored is heated later and transformed into a gas phase, which process is generally referred to as a liquefied gas regasification process.

Conventionally, the task of regasifying the LNG has been performed on the land. As an LNG carrier arrives at a destination port, the LNG is transferred to land-based regasification facilities where the LNG is unloaded by an cryogenic pump and stored in a liquefied state or in a gaseous state.

However, it is difficult to install the dangerous regasification facilities on the land. Further, the regasification facilities pose a severe problem in safety because they are vulnerable to the threat of tenor.

In order to avoid this problem, it is the recent trend that the LNG is regasified on the sea by using an LNG regasification vessel (RV), a floating storage and regasification unit (FSRU) or the like.

Furthermore, it is the conventional method that a natural gas produced in a marine gas field is fed to a land-based liquefaction apparatus through a pipeline and is liquefied by the liquefaction apparatus. The liquefied natural gas is stored in a land storage house and is transferred to an LNG carrier by means of an cryogenic pump.

Along with development of small and medium size gas fields, it is often the case that the liquefied natural gas is regasified on the sea by using floaters such as a floating production storage off-loading (FPSO) unit and the like.

FIG. 1 schematically shows a process of unloading the gas regasified in a conventional LNG regasification vessel or a floating storage and regasification unit. FIG. 2 schematically illustrates an LNG loading process performed in a conventional floating production storage off-loading unit. Referring to FIG. 1, the liquefied natural gas stored in individual storage tanks 10 of a floating storage and regasification unit is regasified and unloaded to the land. In other words, the liquefied natural gas is discharged by pumps 12 arranged within the respective storage tanks 10 and is supplied to a regasification plant 16 through an upwardly-extending pipeline 14. The liquefied natural gas is regasified through a heatup process in the regasification plant 16 and is stably unloaded to the land through seabed pipelines by means of a submerged turret loading (STL) system arranged below the fore part of the floating storage and regasification unit.

Referring to FIG. 2, the natural gas produced in a gas field is loaded to the floating production storage off-loading unit. More specifically, the natural gas just produced in the gas field is introduced into the floating production storage off-loading unit by means of a submerged turret loading system. The natural gas thus introduced is liquefied by a liquefaction plant 24 into a cryogenic state and is loaded to individual storage tanks 20 through a pipeline 22 by means of cryogenic pumps 21.

Since the conventional floaters such as the LNG regasification vessel, the floating storage and regasification unit and the floating production storage off-loading unit are designed to load and unload the liquefied natural gas on the sea, they suffer from a serious drawback in that the storage tanks may be damaged by sloshing. In particular, most of the storage tanks are of a membrane type which is easy to increase the length and width thereof but is vulnerable to the sloshing.

The storage tanks of the floaters may be fabricated into self-supporting storage tanks of a SPB type (Self-supporting Prismatic-Shape IMO type B) or a Moss type that show an increased resistance against sloshing and external shocks. However, the SPB type storage tanks are expensive and, therefore, the LNG carrier becomes costly if the storage tanks are all fabricated into the SPB type. On the other hand, the Moss type storage tanks have no sufficient space for receiving a regasification apparatus and a liquefaction apparatus.

DISCLOSURE OF INVENTION

Technical Problem

In view of the above-noted problems, it is an object of the present invention to provide an LNG carrier having an LNG loading and unloading system in which a membrane type storage tank and a SPB type self-supporting storage tank are arranged in combination and in which a liquefied natural gas is loaded and unloaded through the self-supporting storage tank so as to minimize the influence of sloshing.

Another object of the present invention is to provide an LNG carrier having an LNG loading and unloading system in which a membrane type storage tank and a self-supporting storage tank are interconnected by a separate connection pipeline so that a liquefied natural gas can be moved between the membrane type storage tank and the self-supporting storage tank through the connection pipeline when the liquefied natural gas is loaded to or unloaded through the self-supporting storage tank, thereby avoiding a filling limit which would otherwise be a cause of sloshing.

Technical Solution

In accordance with one aspect of the present invention, there is provided an LNG carrier having an LNG loading and unloading system, including: a submerged turret loading (STL) system for introducing and discharging a natural gas; a liquefaction plant for liquefying the natural gas introduced through the submerged turret loading system into a cryogenic liquefied natural gas; at least one self-supporting storage tank installed in the LNG carrier for storing the liquefied natural gas, the self-supporting storage tank arranged in such a manner that the liquefied natural gas is loaded to and unloaded from the LNG carrier through the self-supporting storage tank; at least one membrane type storage tank arranged in a neighboring relationship with the self-supporting storage tank, the membrane type storage tank kept in fluid communication with the self-supporting storage tank; and a regasification plant for regasifying the liquefied natural gas stored in the self-supporting storage tank.

In accordance with another aspect of the present invention, there is provided an LNG carrier having an LNG loading system, including: a submerged turret loading system for introducing a natural gas; a liquefaction plant for liquefying the natural gas introduced through the submerged turret loading system into a cryogenic liquefied natural gas; at least one self-supporting storage tank for receiving and storing the liquefied natural gas; at least one membrane type storage tank arranged in a neighboring relationship with the self-supporting storage tank, the membrane type storage tank kept in fluid communication with the self-supporting storage tank; a first pipeline arranged between the liquefaction plant and the self-supporting storage tank so that the liquefied natural gas can be loaded to the self-supporting storage tank through the first pipeline; and a second pipeline arranged between the self-supporting storage tank and the membrane type storage tank so that the liquefied natural gas in the self-supporting storage tank can be distributed to the membrane type storage tank through the second pipeline.

In accordance with still another aspect of the present invention, there is provided an LNG carrier having an LNG unloading system, including: at least one membrane type storage tank for storing a liquefied natural gas; at least one self-supporting storage tank for storing the liquefied natural gas, the self-supporting storage tank kept in fluid communication with the membrane type storage tank; a regasification plant for regasifying the liquefied natural gas stored in the self-supporting storage tank; a submerged turret loading system for unloading the natural gas regasified by the regasification plant; a first pipeline arranged between the regasification plant and the self-supporting storage tank so that the liquefied natural gas can be unloaded from the self-supporting storage tank through the first pipeline; and a second pipeline arranged between the self-supporting storage tank and the membrane type storage tank so that the liquefied natural gas in the membrane type storage tank can be fed to the self-supporting storage tank through the second pipeline when the liquefied natural gas is unloaded from the self-supporting storage tank.

In accordance with the present LNG carrier having an LNG loading and unloading system as set forth above, the membrane type storage tank and a SPB type self-supporting storage tank are arranged in combination and a liquefied natural gas is loaded and unloaded through the self-supporting type storage tank. This makes it possible to minimize the influence of sloshing, which in turn helps remove the risk of safety accident. If a self-supporting storage tank with increased structural integrity is arranged in the fore part of the LNG carrier, it becomes possible to satisfy the polar region navigation requirements.

Furthermore, the membrane type storage tank and the self-supporting storage tank are interconnected by the separate connection pipeline so that the liquefied natural gas can be moved between the membrane type storage tank and the self-supporting storage tank through the connection pipeline when the liquefied natural gas is loaded to or unloaded from the self-supporting storage tank. This makes it possible to avoid a filling limit which would otherwise be a cause of sloshing, which in turn assures that the liquefied natural gas is loaded and unloaded in a safe manner.

BRIEF DESCRIPTION OF THE DRAWINGS

The objects and features of the present invention will become apparent from the following description of embodiments given in conjunction with the accompanying drawings, in which.

BEST MODE FOR CARRYING OUT THE INVENTION

Hereinafter, preferred embodiments of an LNG carrier in accordance with the present invention will be described with reference to the accompanying drawings.

Figure 1:
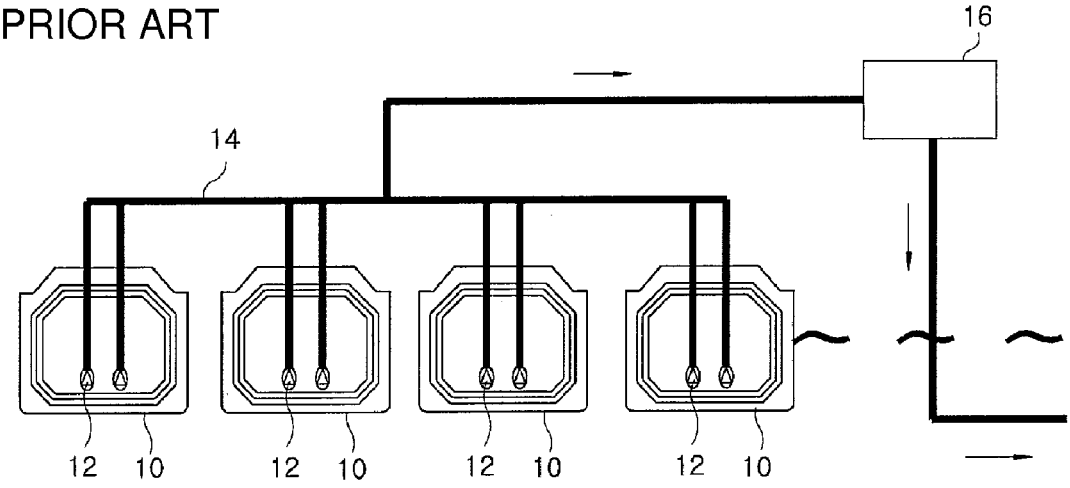
Fig. 1 PRIOR ART
FIG. 1 schematically shows a process of unloading the gas regasified in a conventional LNG regasification vessel or a floating storage and regasification unit (FSRU)
Figure 2:
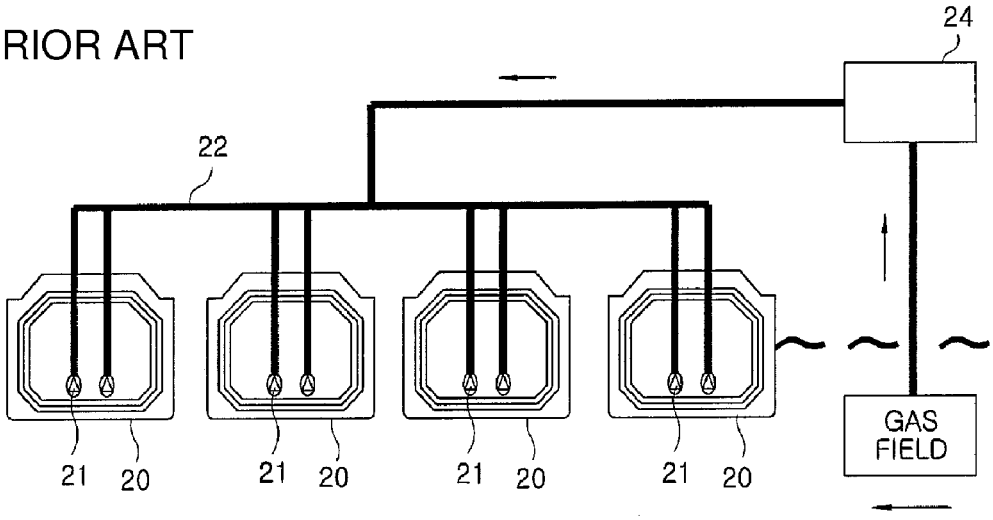
Fig. 2 PRIOR ART
FIG. 2 schematically illustrates an LNG loading process performed in a conventional floating production storage off-loading unit (FPSO)
Figure 3:
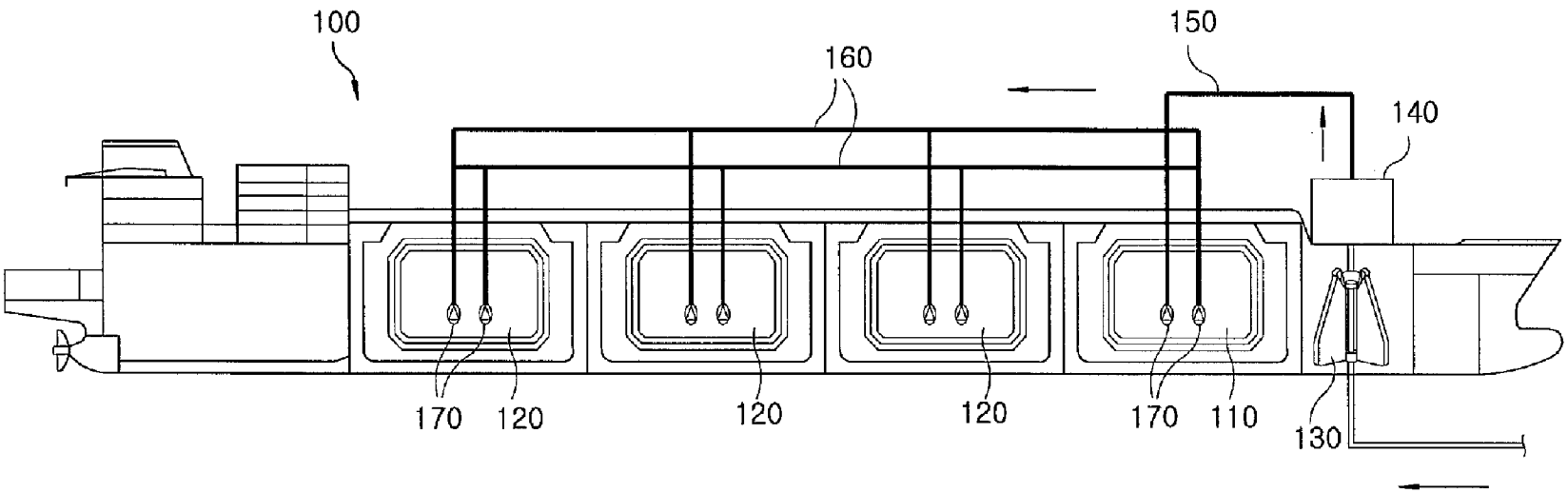
FIG. 3 is a configuration view of an LNG carrier having an LNG loading system in accordance with the present invention.
Figure 4:
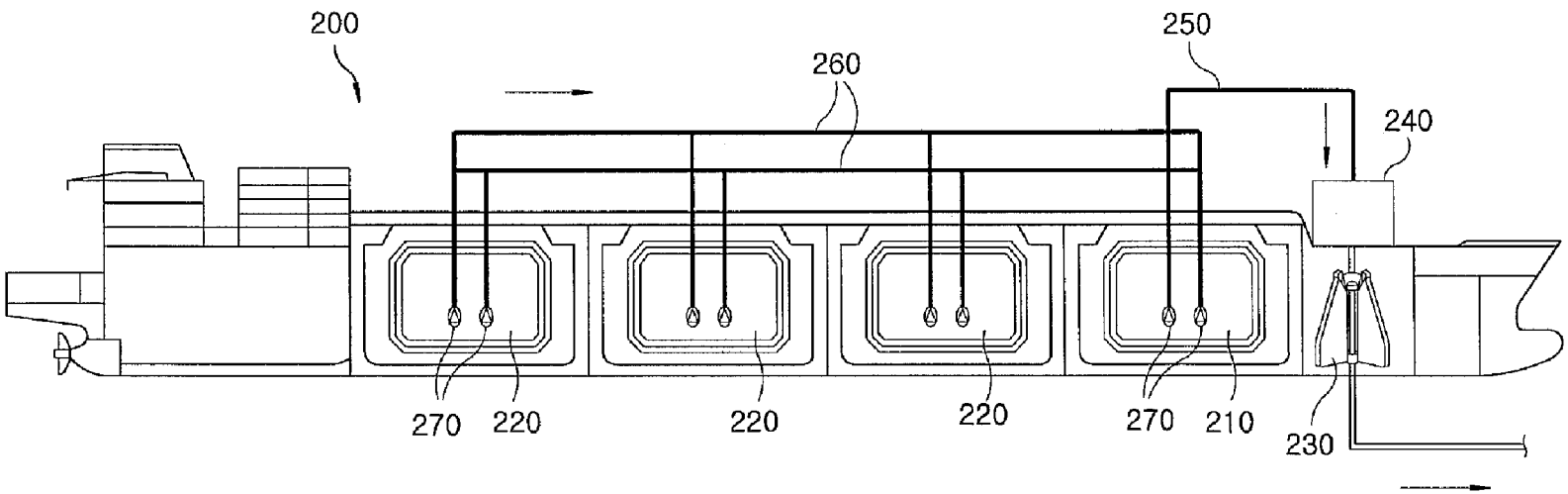
FIG. 4 is a configuration view of an LNG carrier having an LNG unloading system in accordance with the present invention.

FIG. 3 is a configuration view of an LNG carrier having an LNG loading system in accordance with the present invention. FIG. 4 is a configuration view of an LNG carrier having an LNG unloading system in accordance with the present invention.

Referring to FIG. 3, the LNG carrier 100 having an LNG loading system may be a floater, such as a floating production storage off-loading unit (FPSO) or the like, which is floated on the sea and directly supplied with a natural gas. The LNG carrier 100 includes at least one self-supporting storage tank 110 and at least one membrane type storage tank 120, both of which are arranged in combination. The number of the self-supporting storage tank 110 and the membrane type storage tank 120 may vary with the size of the LNG carrier 100.

In this regard, the self-supporting storage tank 110 may be of, e.g., a Moss type or an IHI-SPB type which is costly to produce but resistant to sloshing. Therefore, the self-supporting storage tank 110 is arranged in the fore part and/or after part of the LNG carrier 100 where the sloshing is severely generated by a harsh weather conditions.

The membrane type storage tank 120 may be of, e.g., a Mark-III type and is positioned continuously from the self-supporting storage tank 110 in case where the self-supporting storage tank 110 is arranged in one of the fore part and after part. The membrane type storage tank 120 is positioned between two self-supporting storage tanks in case where the self-supporting storage tanks are arranged in the fore part and after part of the LNG carrier 100. In other words, the membrane type storage tank 120 is installed in a position other than the fore part and after part to avoid the influence of sloshing and to eliminate the risk of safety accident.

The LNG carrier 100 in which the membrane type storage tank 120 and the self-supporting storage tank 110 are arranged in combination includes a submerged turret loading (STL) system 130 provided in the fore part thereof for stably introducing the natural gas produced in a gas field. The LNG carrier 100 further includes a liquefaction plant 140 by which the natural gas introduced through the submerged turret loading system 130 is liquefied into a cryogenic liquid.

The liquefaction plant 140 is connected to the self-supporting storage tank 110 via a first pipeline 150. One end of the first pipeline 150 is located inside the self-supporting storage tank 110. Installed at the end of the first pipeline 150 is a pump 170 that assists in storing the natural gas liquefied by the liquefaction plant 140.

The self-supporting storage tank 110 and the membrane type storage tank 120 are connected by second pipelines 160. The liquefied natural gas filled in the self-supporting storage tank 110 through the first pipeline 150 is distributed to the membrane type storage tank 120 via the second pipelines 160. The second pipelines 160 extend into the membrane type storage tank 120 in pair. Pumps 170 are installed at the ends of the second pipelines 160.

Referring to FIG. 4, there is shown an LNG carrier 200 having an LNG unloading system in accordance with the present invention. The unloading system of the LNG carrier 200 is designed to regasify the liquefied natural gas in a floating state on the sea and to supply the regasified natural gas to the land facilities through seabed pipelines. The LNG carrier 200 may be a floater such as an LNG regasification vessel, a floating storage and regasfication unit (FSRU) or the like. The LNG carrier 200 includes at least one self-supporting storage tank 210 and at least one membrane type storage tank 220, both of which are arranged in combination. The number of the self-supporting storage tank 210 and the membrane type storage tank 220 may vary with the size of the LNG carrier 200.

Just like the floating production storage off-loading unit (FPSO) mentioned earlier, the self-supporting storage tank 210 may be of, e.g., a Moss type or an IHI-SPB type, and is arranged in the fore part and/or after part of the LNG carrier 200.

The membrane type storage tank 220 may be of, e.g., a Mark-III type and is positioned continuously from the self-supporting storage tank 210 in case where the self-supporting storage tank 210 is arranged in one of the fore part and after part. The membrane type storage tank 220 is positioned between two self-supporting storage tanks in case where the self-supporting storage tanks are arranged in the fore part and after part of the LNG carrier 200.

A pump 270 is installed in the self-supporting storage tank 210. The pump 270 is connected to a regasification plant 240 of the LNG carrier 200 through a first pipeline 250. The regasification plant 240 is designed to heat up and regasify the cryogenic liquefied natural gas.

The natural gas regasified in the regasification plant 240 is unloaded to the land by means of a submerged turret loading (STL) system 230 provided in the fore part of the LNG carrier 200 for stabilizing the process of feeding the natural gas through seabed pipelines.

The self-supporting storage tank 210 and the membrane type storage tank 220 are connected by second pipelines 260. The second pipelines 260 are used to feed the liquefied natural gas filled in the membrane type storage tank 220 to the self-supporting storage tank 210 when the liquefied natural gas is unloaded from the self-supporting storage tank 210 through the first pipeline 250. The second pipelines 260 extend into the membrane type storage tank 220 in pair. Pumps 270 are installed at the ends of the second pipelines 160.

The present invention may be applied to an LNG carrier other than the floating production storage off-loading unit (FPSO), the LNG regasification vessel and the floating storage and regasification unit (FSRU). Furthermore, the liquefaction plant 140 and the regasification plant 240 may be installed in a single LNG carrier having both self-supporting storage tank and membrane type storage tank so that the liquefied natural gas can be loaded and unloaded.

Description will now be made on the operation of the LNG carrier having an LNG loading and unloading system as configured above.

First, a process of loading the natural gas performed in the floating production storage off-loading unit (FPSO) will be described with reference to FIG. 3. The natural gas produced in a marine gas field is stably introduced into the LNG carrier 100 by means of the submerged turret loading plant 130 and is transformed into a cryogenic liquefied natural gas while passing through the liquefaction plant 140.

The liquefied natural gas is first sent to the self-supporting storage tank 110 via the first pipeline 150. If the liquefied natural gas is filled up to a certain level in the self-supporting storage tank 110, it is distributed to the membrane type storage tank 120 through the second pipelines 160 by means of the pump 170.

Even if the self-supporting storage tank 110 is arranged in the position where severe sloshing occurs, the sloshing may affect the membrane type storage tank 120. The membrane type storage tank 120 may be quite vulnerable to the sloshing during the time when the liquefied natural gas is filled in 10 to 70% of the membrane type storage tank 120. In view of this, it is preferred that the liquefied natural gas is suitably distributed through the second pipelines 160 depending on wave conditions on the sea. Further, it is preferred that the liquefied natural gas is distributed in such a manner as to reduce the time period during which 10 to 70% of the membrane type storage tank 120 is filled with the liquefied natural gas.

Next, a process of unloading the natural gas performed in the LNG regasification vessel or the floating storage and regasification unit (FSRU) will be described with reference to FIG. 4. The liquefied natural gas filled in the self-supporting storage tank 210 installed in the fore part or after part of the LNG carrier 200 is discharged through the first pipeline 250 by means of the pump 270. Simultaneously, the liquefied natural gas stored in the membrane type storage tank 220 is fed to the self-supporting storage tank 210 through the second pipelines 260 by means of the pumps 270 provided in the membrane type storage tank 220. This means that the liquefied natural gas stored in the membrane type storage tank 220 is discharged via the self-supporting storage tank 210 at all times. Further, movement of the liquefied natural gas between the membrane type storage tanks 220 helps minimize the sloshing which would occur when 10 to 70% of the membrane type storage tank 220 is filled with the liquefied natural gas.

The liquefied natural gas discharged through the first pipeline 250 is regasified by the regasification plant 240 and then unloaded to the land through the seabed pipelines by means of the submerged turret loading system 230.

With the present invention described above, a self-supporting storage tank and a membrane type storage tank are arranged in combination in the floaters such as the LNG regasification vessel, the floating storage and regasification unit (FSRU) and the floating production storage off-loading unit (FPSO). The liquefied natural gas is loaded and unloaded through the self-supporting type storage tank that has an increased resistance against the sloshing. This makes it possible to overcome the sloshing. If the self-supporting storage tank with increased structural integrity is arranged in the fore part of an LNG carrier, it becomes possible for the LNG carrier to navigate the polar region.

While the invention has been shown and described with respect to the embodiments, it will be understood by those skilled in the art that various changes and modifications may be made without departing from the scope of the invention as defined in the following claims.

The invention claimed is:

1. An LNG carrier having an LNG loading and unloading system, comprising:

a submerged turret loading (STL) system for introducing and discharging a natural gas;

a liquefaction plant for liquefying the natural gas introduced through the submerged turret loading system into a cryogenic liquefied natural gas;

at least one self-supporting storage tank installed in the LNG carrier for storing the liquefied natural gas, the self-supporting storage tank arranged in such a manner that the liquefied natural gas is loaded to and unloaded from the LNG carrier through the self-supporting storage tank;

at least one membrane type storage tank arranged in a neighboring relationship with the self-supporting storage tank, the membrane type storage tank kept in fluid communication with the self-supporting storage tank; and a regasification plant for regasifying the liquefied natural gas stored in the self-supporting storage tank.

2. The LNG carrier of claim 1, wherein the self-supporting storage tank is installed in a fore part and/or after part of the LNG carrier.

3. The LNG carrier of claim 1, wherein the liquefaction plant is connected to the self-supporting storage tank through a first pipeline.

4. The LNG carrier of claim 1, wherein the regasification plant is connected to the self-supporting storage tank through a second pipeline.

5. The LNG carrier of claim 1, wherein the self-supporting storage tank and the membrane type storage tank are connected to each other through a storage tank pipeline.

6. An LNG carrier having an LNG loading system, comprising:

a submerged turret loading system for introducing a natural gas;

a liquefaction plant for liquefying the natural gas introduced through the submerged turret loading system into a cryogenic liquefied natural gas;

at least one self-supporting storage tank for receiving and storing the liquefied natural gas;

at least one membrane type storage tank arranged in a neighboring relationship with the self-supporting storage tank, the membrane type storage tank kept in fluid communication with the self-supporting storage tank;

a first pipeline arranged between the liquefaction plant and the self-supporting storage tank so that the liquefied natural gas can be loaded to the self-supporting storage tank through the first pipeline; and a second pipeline arranged between the self-supporting storage tank and the membrane type storage tank so that the liquefied natural gas in the self-supporting storage tank can be distributed to the membrane type storage tank through the second pipeline.

7. The LNG carrier of claim 6, wherein the LNG carrier is a floating production storage off-loading unit (FPSO).

8. The LNG carrier of claim 6, wherein the self-supporting storage tank is installed in a fore part and/or after part of the LNG carrier.

9. The LNG carrier of claim 6, wherein the second pipeline comprises two or more pipelines extending into the membrane type storage tank.

10. An LNG carrier having an LNG unloading system, comprising:

at least one membrane type storage tank for storing a liquefied natural gas;

at least one self-supporting storage tank for storing the liquefied natural gas, the self-supporting storage tank kept in fluid communication with the membrane type storage tank;

a regasification plant for regasifying the liquefied natural gas stored in the self-supporting storage tank;

a submerged turret loading system for unloading the natural gas regasified by the regasification plant;

a first pipeline arranged between the regasification plant and the self-supporting storage tank so that the liquefied natural gas can be unloaded from the self-supporting storage tank through the first pipeline; and a second pipeline arranged between the self-supporting storage tank and the membrane type storage tank so that the liquefied natural gas in the membrane type storage tank can be fed to the self-supporting storage tank through the second pipeline when the liquefied natural gas is unloaded from the self-supporting storage tank.

11. The LNG carrier of claim 10, wherein the LNG carrier is an LNG regasification vessel or a floating storage and regasification unit (FSRU).

12. The LNG carrier of claim 10, wherein the self-supporting storage tank is installed in a fore part and/or after part of the LNG carrier.

13. The LNG carrier of claim 10, wherein the second pipeline comprises two or more pipelines extending into the membrane type storage tank.

* * * * *